United States Patent [19]

Bibeau et al.

[11] 4,027,787

[45] June 7, 1977

[54] SHIPPING CONTAINER

[76] Inventors: Marcel Bibeau, 4611 Castel d'Autray, St. Felix de Valois, Joliette County, Quebec; Marcellin Barrette, 1013 Berard Avenue, Val d'Or, Abitibi East, Quebec, both of Canada

[22] Filed: Feb. 5, 1976

[21] Appl. No.: 655,380

[52] U.S. Cl. ..... 222/166; 222/479; 222/181

[51] Int. Cl.[2] ..... B67D 5/64; B67D 3/00

[58] Field of Search ..... 222/478, 479, 482, 166, 222/165, 164; 220/1.5

[56] References Cited

UNITED STATES PATENTS

| | | | |
|---|---|---|---|
| 1,285,074 | 11/1918 | Draper | 222/479 X |
| 2,035,838 | 3/1936 | Reeder et al. | 220/1.5 X |
| 2,614,817 | 10/1952 | Pyle et al. | 222/478 X |
| 3,220,612 | 11/1965 | Thomson | 220/15 X |

*Primary Examiner*—Stanley H. Tollberg
*Assistant Examiner*—Hadd Lane

[57] ABSTRACT

An invertible shipping container for shipping particulate material and including a shell forming a main portion of right quadrilateral cross-section and having a flat closed bottom, a pair of top mouths and a dual funnel portion joining the main portion to the pair of mouths and tapering towards the latter at relatively steep and distinct funnel angles to enhance tumbling instead of producing jamming by the bridging effect upon discharge of the material from both mouths of the inverted container. When the container is upright, one mouth of the container is used for filling while the other is used to suck out dust and air. A releasable cover closes each mouth and carrying devices are secured to the main portion to carry and tilt the container for emptying.

2 Claims, 9 Drawing Figures

SHIPPING CONTAINER

This invention relates to an invertible transport container for shipping material and, more particularly, to a container of the type adapted to ship particulate material.

In the prior art, there is proposed cross-section shipping container of the above type which includes a shell forming a main portion, a mouth and a funnel portion joining the main portion to the mouth and gradually tapering towards the latter at an angle exceeding the angle of repose of the material being shipped. With a single mouth as heretofore proposed, the funnel portion must be relatively high as compared to the main portion in order to produce the desired angle. Besides, the afore-mentioned prior container has a funnel portion of uniform cross-sention having the same funneling angle all around. There results a "bridge effect," that is jamming of the particulate material in partly emptied condition upon emptying the container. This "bridge effect" or jamming is produced in the funnel by converging of the material towards the mouth, thus producing a compaction of the particles against each other upon approaching the mouth.

It is a general object of the invention to provide a shipping container of the above type which substantially avoids the abovementioned disadvantages without increasing the height of the funnel portion as compared to the main portion.

It is a more specific object of the invention to provide a shipping container of the above type with a main portion, a pair of mouths and a dual funnel portion joining the main portion to the mouths and producing relatively steeper and distinct funnel angles, such that the latter produces discharge of the material at different relative speeds producing a tumbling effect instead of the bridging effect.

It is another object of the invention to provide an invertible shipping container of the above type, in which the main portion is of right quadrilateral cross-section and which has a closed flat bottom for placing several containers side by side without lost space.

It is another object of the invention to provide a shipping container of the above type with a pair of mouths wherein, when the container is upright, one mouth is used for filling the container, while the other is used to suck out the dust and air, and when the container is inverted, both mouths are used to speed up emptying of the container.

The above and other objects and advantages of the invention will be better understood with reference to the following detailed description of a preferred embodiment thereof, which is illustrated, by way of example only, in the accompanying drawings, in which.

Figure 1:
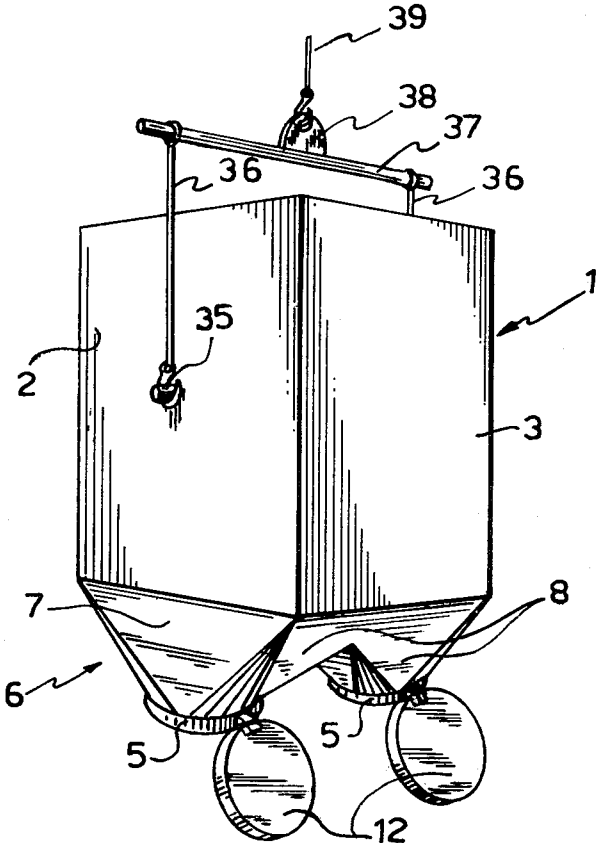
FIG. 1 is a perspective view of a shipping container according to the present invention shown in the discharging position suspended by a crane.
Figure 2:
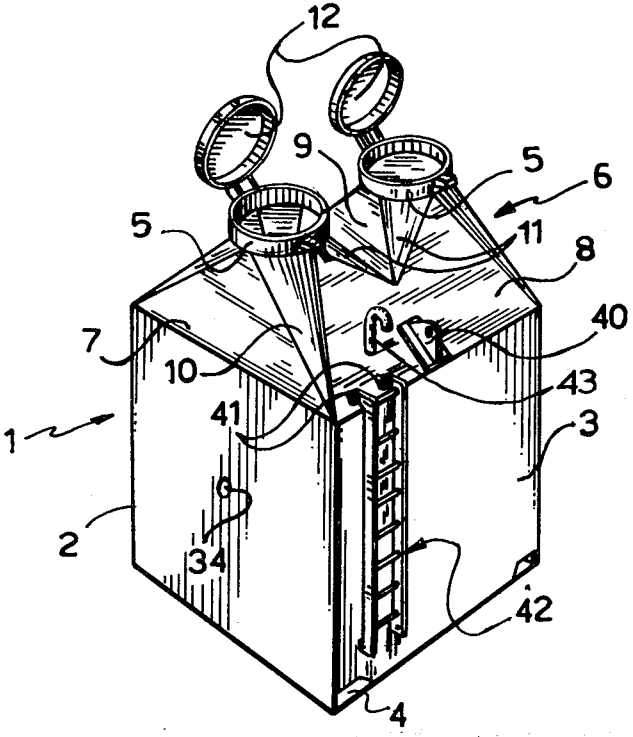
FIG. 2 is a perspective view of the same container in the ready-to-fill position.
Figure 3:
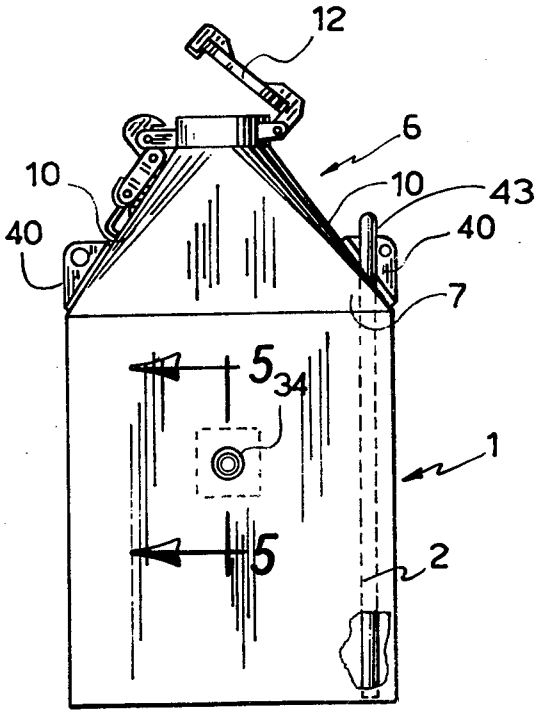
FIG. 3 and FIG. 4 are side and front views respectively of the same shipping container.
Figure 5:
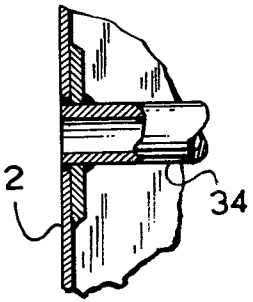
FIG. 5 is a cross-sectional enlarged view as seen along line 5—5 in FIG. 3.
Figure 4:
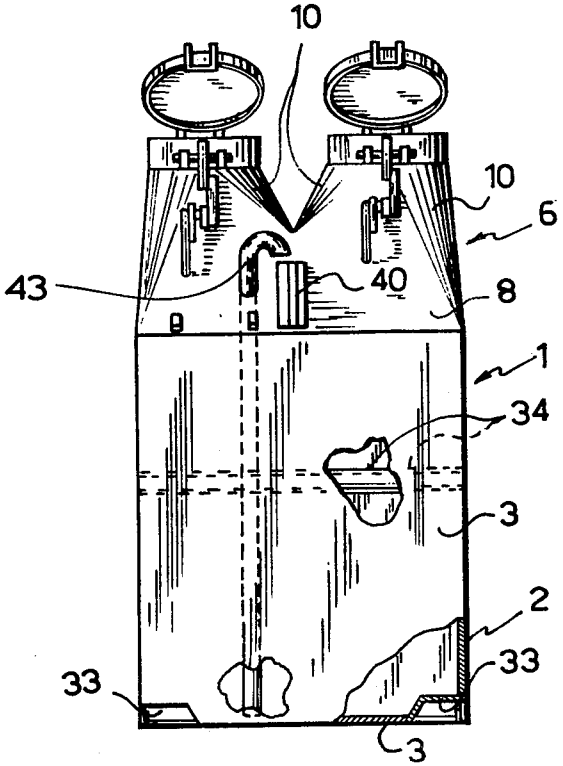
Figure 6:
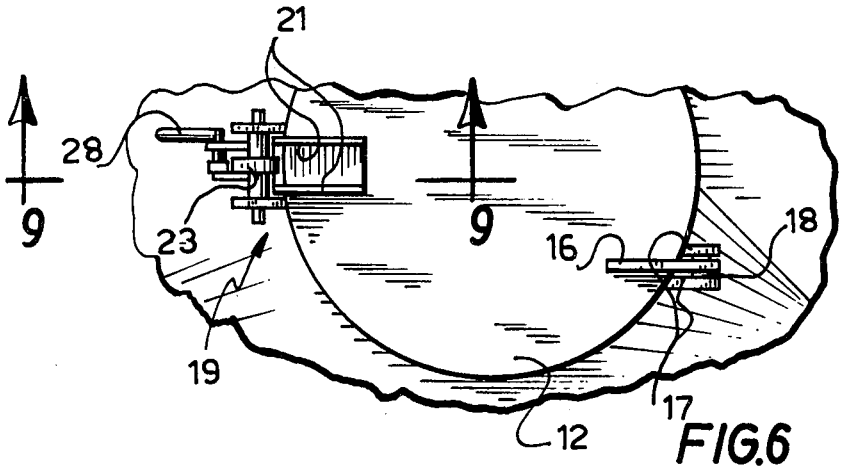
FIG. 6 is a top view of one mouth of the container with the associated cover, hinge and latch.
Figure 7:
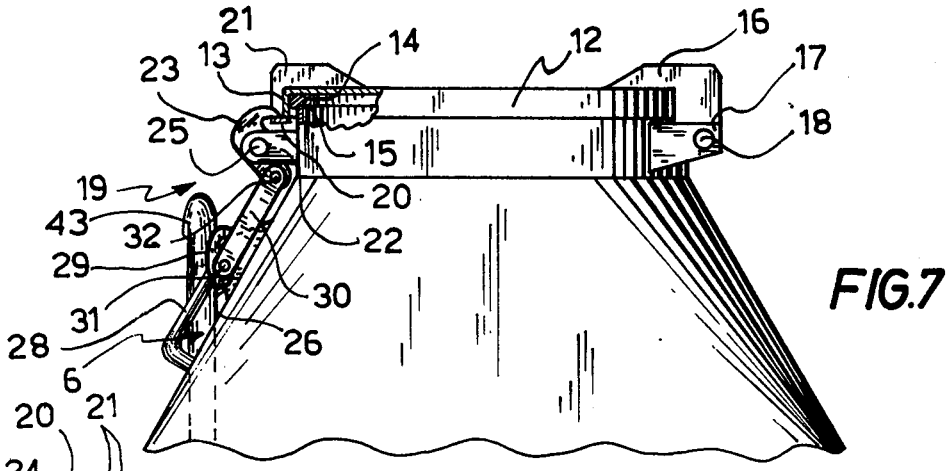
FIG. 7 is a cross-sectional view as seen along line 7—7 in FIG. 6.
Figure 8:
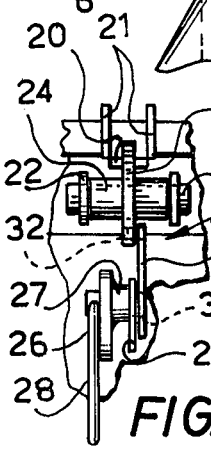
FIG. 8 is a front view of the toggle latch releasably closing the cover of one mouth of the container.
Figure 9:
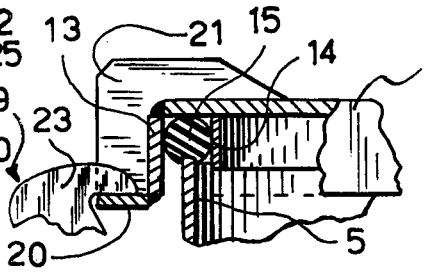
FIG. 9 is a partial cross-section of the mouth, cover and latch.

The illustrated shipping container includes a shell having a main body portion 1, of generally right guadrilateral cross-section, preferably square, flat side walls 2, other opposite flat side walls 3 and a flat bottom 4. Side walls 2 have a straight top edge uniformly distant from bottom 4. The above-mentioned shell also includes at the top a pair of circular mouths of equal diameter and located at the same level and each formed of a cylindrical ring member 5. The shell also includes a dual funnel portion 6 joining the side walls 2 and 3 to the cylindrical ring members 5 and consisting of a plurality of funneling walls 7, 8, 9, 10, and 11. Flat walls 7 join with the top edges of walls 2 and converge at the same angle. Flat walls 8 join with the top edges of walls 3 and converge at the same funneling angle. Walls 8 are common to the two mouths 5 and the latter are located along a line parallel to and equally distant from walls 3. Flat walls 9 form an inverted central V having the same funneling angle but less steep than the angle of opposite walls 7. Walls 9 join along a straight line parallel to, above and equally distant from the top edges of walls 2. Walls 10 and 11 are curved and join walls 7 and 8 and 8 and 9, respectively. The use of two mouths allows to form inclined surfaces of relatively steep funneling angles all exceeding the angle of repose of the material loaded into the container. In each of the two funnel portions, the opposite walls 7 and 9 have different inclinations or funneling angles, outer walls 7 being steeper. This structure avoids the bridging effect or jamming usually encountered with a container having a single mouth and produces correspondingly different rates of discharge along these surfaces and a resultant tumbling amongst the discharging particles of material.

A circular cover 12 is provided to close each mouth aperture defined by a cylindrical ring 5. Each cover 12 includes a cylindrical rim 13 fitting around the corresponding cylindrical rim 5 and an internal ridge 14 fitting inwardly of the cylindrical ring 5 and forming an annular space with the rim 13. An annular pad 15 is fitted into this annular space to tightly engage the ring 5. Each cover 12 is provided with a pair of spaced parallel hinge members 16 rigidly secured thereto and engaging between pairs of spaced-apart lugs 17 and pivoted to the latter by suitable pivot pins 18 parallel to side walls 3. The lugs 17 are secured to the cylindrical rings 5 and project outwardly on the same side of the latter.

A toggle latch 19 is provided on the opposite side of each cover 12 relative to the hinge of the latter. Each cover 12 is provided with a radial projection 20 extending outwardly of the rim 13 for engagement by the corresponding latch 19. A pair of side plates 21 are secured to the opposite sides of the radial projection 20. A pair of lugs 22 are secured to each cylindrical ring 5 and project outwardly therefrom in spaced-apart relationship below the radial projection 20. A latching member 23 includes a sleeve portion 24 extending transversely thereof and pivoted onto a pin 25 carried by the lugs 22. A lug 26 is secured on the funnel portion 6 and projects outwardly therefrom parallel to the lugs 22. The lug 26 has a sleeve portion 27 projecting transversely thereof. An actuating crank lever 28 is pivoted on the sleeve portion 27 and includes a crank arm 29 rotating therewith. A toggle lever 30 is pivoted at one end by a pin 31 to the crank arm 29 and by a pin 32 to the free end of the latching member 23.

As shown in the drawings, the actuating lever 28 cooperates with the crank arm 29 and the toggle lever 30 to form a toggle mechanism to latch the associated cover 12 in closed position and to release the latter by appropriate positioning of the actuating lever 28.

The shipping container according to the invention is formed with suitable apertures 33 arranged in spaced-apart relationship at the base thereof, such as through any side wall 3, to engage the forks of a fork lift truck therein to carry the container. A tube 34 is secured transversely into the main body portion 1 and opens outwardly through the side walls 2 for insertion of a holding rod 35 through both ends thereof to carry or suspend the container through the latter. This holding rod 35 may be suspended in any suitable manner, such as by chains 36 hooked to a yoke 37 suspended by the chain block 38 of a boom 39. A pair of brackets 40 are secured on opposite sides of the container to attach the opposite ends of a sling, not shown, thereto and thus support the same.

Lugs 41 are also fixed to the dual funnel of the container in spaced-apart relationship to removably suspend a ladder 42 therefrom for access to the mouths 5, the covers 12 and the latches 19 for the latter.

The container is filled through one mouth only, while the other mouth is used to suck out the air and dust during the filling.

Preferably, the container is fitted with a vent tube 43 having an inner air outlet end adjacent to the container bottom, extending through inclined wall 8 and having a U-shaped outer end air inlet portion to prevent rain or snow from entering the container. This vent tube 43 accelerates emptying of the container. The container, with ladder 42 removed, is free of any projections which would protrude from the side walls 2 and 3, so that several shipping containers can be positioned side by side with their side walls in contact.

We claim:

1. A shipping container for particulate material, comprising a container portion of square or rectangular cross-section with a closed flat bottom and flat side walls having a straight top edge uniformly distant from said bottom, and a dual funnel portion forming a pair of funnels both tapering upwardly from the top of said container portion in lateral relationship and forming a pair of equal diameter circular mouths truncating the smaller end of the funnels respectively and located at the same level and along a line parallel to and equally distant from a first pair of parallel side walls, both funnels including a pair of equally inclined flat walls each common to both funnels and joining with the top edges of the first pair of side walls respectively, both funnels further including an inclined outer flat wall joining with the top edge of the side wall of the second pair of side walls, and an inclined inner flat wall joining with the inclined inner flat wall of the other funnel along a straight line parallel to, above and equally distant from the top edges of the side walls of said second pair, said outer flat walls forming a steeper funneling angle than that of said inner flat walls, a circular cover for closing each mouth pivoted to the latter about a pivotal axis parallel to said first pair of side walls for pivotal movement between a mouth closing position engaging said mouth and a mouth opening position lying against said funnel, latch means carried by said funnels engageable with said covers to removably latch the latter in closed position, a tube extending through said container portion, secured to, opening and terminating at said other pair of side walls, said tube parallel to said bottom and to said first pair of said side walls, said tube serving to receive a supporting rod about which said container can be supported and pivoted, said container being free of any projections, such as said covers, whether open or closed, said latch means and said tube, which would protrude from said side walls, so that several shipping containers can be positioned side by side with their side walls in contact.

2. A shipping container as defined in claim 1, further including a vent tube opening within said container at one end, close to said bottom, and extending through the wall of one of the funnels at the exterior of the container to terminate at its other end by a U-shaped air outlet at the level of said funnels and inwardly of the cross-sectional area of said container portion.

* * * * *